United States Patent [19]

Gill

[11] Patent Number: 4,640,082

[45] Date of Patent: Feb. 3, 1987

[54] APPARATUS FOR PACKAGING LOOSE FIBROUS MATERIAL

[75] Inventor: Gurdev S. Gill, Newark, Ohio

[73] Assignee: Owens-Corning Fiberglas Corporation, Toledo, Ohio

[21] Appl. No.: 707,623

[22] Filed: Mar. 4, 1985

[51] Int. Cl.[4] ..... B65B 1/20

[52] U.S. Cl. ..... 53/523; 53/528; 53/550

[58] Field of Search ..... 53/87, 451, 550, 551, 53/510, 523, 526, 528, 529, 530, 511; 100/229 A, 90; 141/313

[56] References Cited

U.S. PATENT DOCUMENTS

| | | | |
|---|---|---|---|
| 2,815,621 | 12/1957 | Carter | 100/90 X |
| 2,954,730 | 10/1960 | Moser | 100/90 X |
| 2,984,172 | 5/1961 | Roberts et al. | 53/523 X |
| 3,057,130 | 10/1962 | Helwig | 53/510 X |
| 3,222,853 | 12/1965 | Micheal | 53/530 X |
| 3,546,846 | 12/1970 | Sens | 53/529 X |
| 3,580,166 | 5/1971 | Longo | 53/529 X |
| 3,583,312 | 6/1971 | VanDorn | 100/90 |
| 4,111,113 | 9/1978 | Lambert | 100/90 X |
| 4,272,944 | 6/1981 | Suga | 53/511 |
| 4,343,131 | 8/1982 | McCormick et al. | 53/526 X |
| 4,389,931 | 6/1983 | Sutter | 100/90 |
| 4,457,125 | 7/1984 | Fishburne | 53/510 X |

FOREIGN PATENT DOCUMENTS

| | | | |
|---|---|---|---|
| 289832 | 7/1914 | Fed. Rep. of Germany | 53/523 |
| 2810244 | 9/1979 | Fed. Rep. of Germany | 141/313 |
| 610733 | 6/1978 | U.S.S.R. | 53/510 |

*Primary Examiner*—John Sipos
*Assistant Examiner*—Steven P. Weihrouch
*Attorney, Agent, or Firm*—Ronald C. Hudgens; Greg Dziegielewski; Paul J. Rose

[57] ABSTRACT

The apparatus of each embodiment includes a suction housing having a perforated duct therein. Fibrous material supplied to the inlet of the duct is compacted by air being evacuated through the perforated sidewall of the duct. The continuous compacting of fibrous material aids in moving the already compacted material out the outlet of the duct.

2 Claims, 11 Drawing Figures

APPARATUS FOR PACKAGING LOOSE FIBROUS MATERIAL

TECHNICAL FIELD

This invention relates generally to packaging of loose fibrous material, and more particularly to apparatus for packaging loose fibrous material wherein the material is vacuum-compacted in a perforated wall portion of a duct, and air is removed from the duct through the perforated wall portion.

BACKGROUND ART

U.S. Pat. No. 3,458,966 discloses placing fibrous material in an impervious flexible enclosure such as a polyethylene bag, removing air from the bag to create a partial vacuum therein and cause atmospheric pressure to compress the bag and the fibrous material therein, and telescoping a restricting sleeve over the bag.

DISCLOSURE OF INVENTION

Several embodiments of the invention are hereinafter disclosed wherein loose fibrous material is vacuum-compacted in a perforated portion of a duct, air being removed from the duct through the perforated wall portion.

BRIEF DESCRIPTION OF THE DRAWINGS

The invention is hereinafter more fully described, reference being had to the accompanying drawings wherein.

BEST MODE OF CARRYING OUT THE INVENTION

Figure 1:
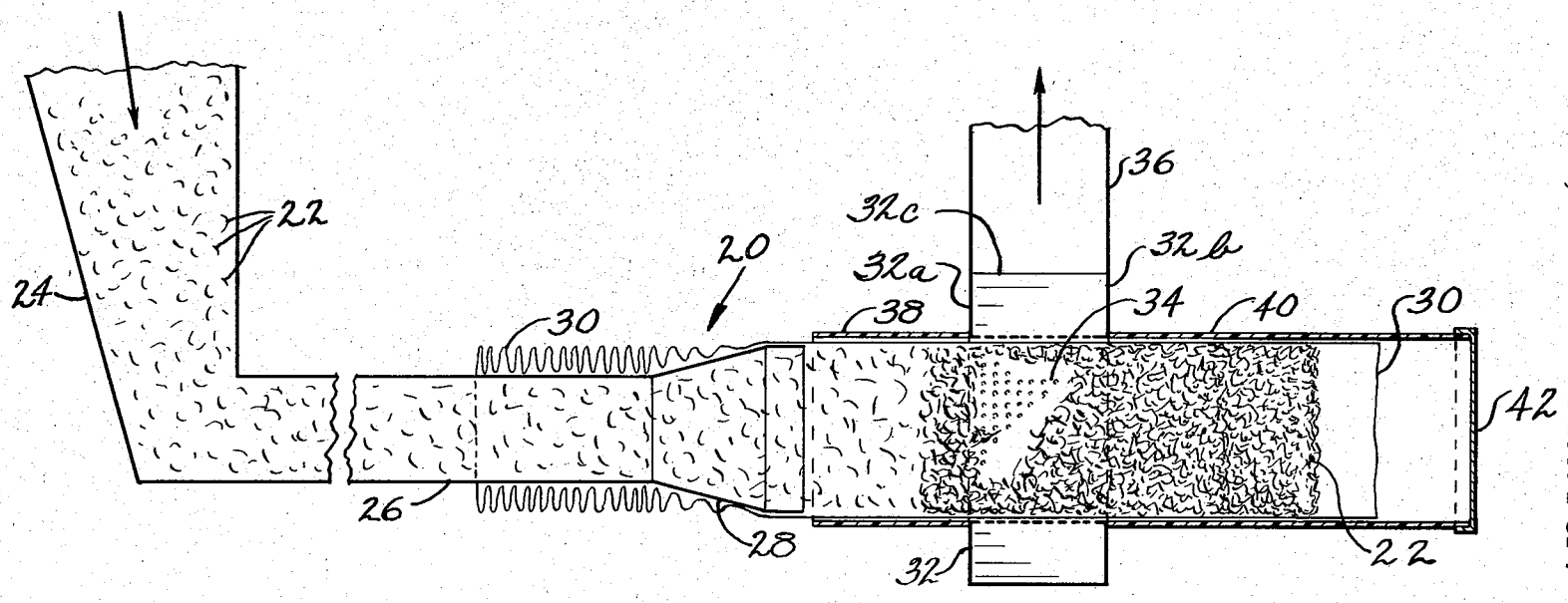
FIG. 1 is a fragmentary schematic elevational view, partly in section, of packaging apparatus illustrating a first embodiment of the invention.

With reference to the drawings, FIG. 1 shows an apparatus 20 constructed in accordance with the invention and making use of a partial vacuum to compact and package loose fibrous material 22. The apparatus 20 includes an air and fiber inlet chute 24 connected to a duct 26 having a flared downstream end 28. On the exterior, the duct 26 serves as a support for a supply of porous sleeve material 30, which may be perforated plastic film or may be Reemay, a spunbonded polyester available from duPont in Wilmington, Delaware. A suction housing 32 including a pair of opposite end walls 32*a* and 32*b* with openings respectively therein and an enclosing sidewall 32*c* has a perforated duct 34 running therethrough. An air exhaust duct 36 connected to the housing 32 leads to a suction fan (not shown). An inlet duct 38, aligned with the perforated duct 34 and preferably made of transparent plastic such as Plexiglas, guides the porous sleeve material 30, air, and fibrous material 22 into the housing 32. An outlet duct 40, aligned with the perforated duct 34 and also preferably made of transparent plastic, guides the suction-compacted fibrous material 22, encased in the sleeve material 30, from the housing 32. The downstream end of the outlet duct 40 is covered by a cap 42. The exhausting of air from the suction housing 32 compacts the fibrous material 22 and the leading compacted mass of fibers 22 is moved along the duct 40, pulling the sleeve material 30 therewith, by the continuous compacting of fibers farther upstream. When the duct 40 is full, the cap 42 is removed, the filled sleeve material 30 is pulled out and cut to length, and some compacted fibrous material 22 is removed if desired to enable folding of the sleeve material 30 at the leading end to form a bag.

Figure 2:
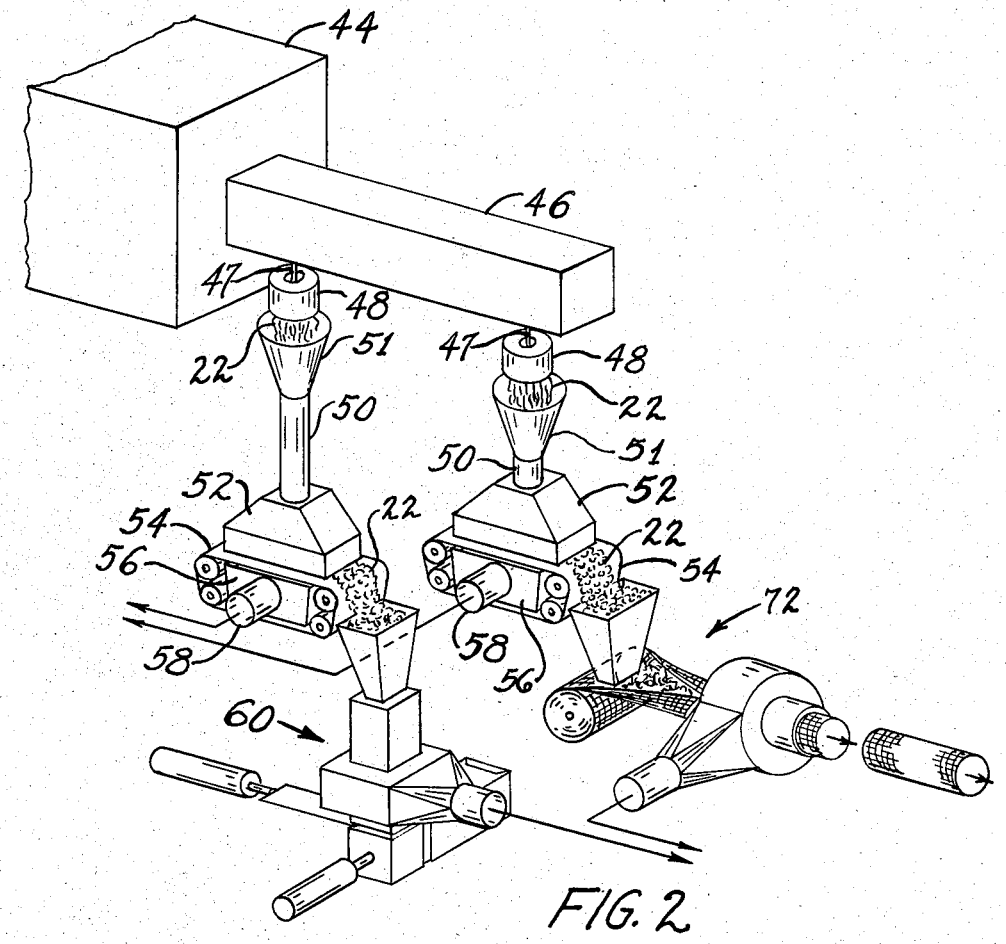
FIG. 2 is a fragmentary schematic isometric view of packaging apparatus illustrating second and third embodiments of the invention.

FIG. 2 schematically shows a glass batch melting furnace 44 having a forehearth 46 feeding molten glass streams 47 respectively to a pair of fiber forming bushings 48 forming glass fiber material 22. The two streams of glass fiber material 22 pass respectively through conduits 50, having flared upper ends 51, to forming hoods 52 disposed respectively above upper flights of travelling porous conveyor belts 54. Suction boxes 56 disposed beneath upper flights of the conveyor belts 54 have exhaust ducts 58 connected to a suction fan (not shown). The glass fiber material 22 from one of the conveyor belts 54 passes to a packaging apparatus 60 constructed in accordance with the invention and more clearly shown in FIG. 3, while the glass fiber material 22 from the other of the conveyor belts 54 passes to a packaging apparatus 72 constructed in accordance with the invention and more clearly shown in FIG. 4.

The apparatus 60 includes a chute 61 having an outlet end connected to an inlet duct 62 leading to a suction housing 63 including a pair of opposite end walls 63*a* and 63*b* with openings respectively therein and an enclosing sidewall 63*c*. A perforated duct 64 aligned with the inlet duct 62 runs through the housing 63. An air exhaust duct 65 connected to the housing 63 leads to a suction fan (not shown). During compaction of glass fiber material 22 within the duct 64, a bagging housing 66 is closed off from the duct 64 by a gate 67 movable to open and closed positions by an actuator 68. The gate 67 is opened periodically to allow passage of compacted glass fiber material 22 into the bagging housing 66 and then closed again. An actuator 69 then advances a pushing plate (not shown) to push compacted glass fiber material 22 into a bag 70 attached to the housing 66 and retracts the pushing plate before the gate 67 is opened again.

The apparatus 72 includes a chute 73 for depositing glass fiber material 22 on scrim 74 fed from a supply roll 75. After receiving the glass fiber material, the scrim 74 is progressively formed into a cylindrical shape as it passes into an inlet duct 76 leading to a suction housing 77 including a pair of opposite end walls 77*a* and 77*b* with openings respectively therein and an enclosing sidewall 77*c*. A perforated duct 78 aligned with the inlet duct 76 runs through the housing 77. An air exhaust duct 79 connected to the housing 77 leads to a suction fan (not shown). An outlet duct 80 aligned with the perforated duct 78 extends from the suction housing 77 and guides the compacted glass fiber material 22, encased in a sleeve of the scrim 74, to cutting means (not shown) for cutting the encased material into desired lengths. Heat sealing means (not shown) is provided to form a seam in the scrim sleeve. The scrim 74 and compacted glass fiber material 22 are pulled from the outlet duct 80 while more glass fiber material 22 is being compacted farther upstream.

Figure 6:
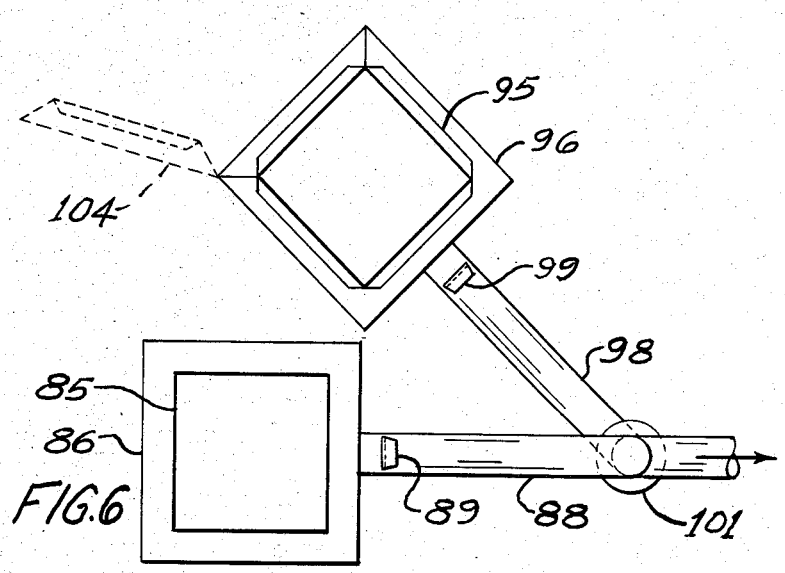
FIG. 6 is a fragmentary sectional view taken along the line 6—6 of FIG. 5.
Figure 5:
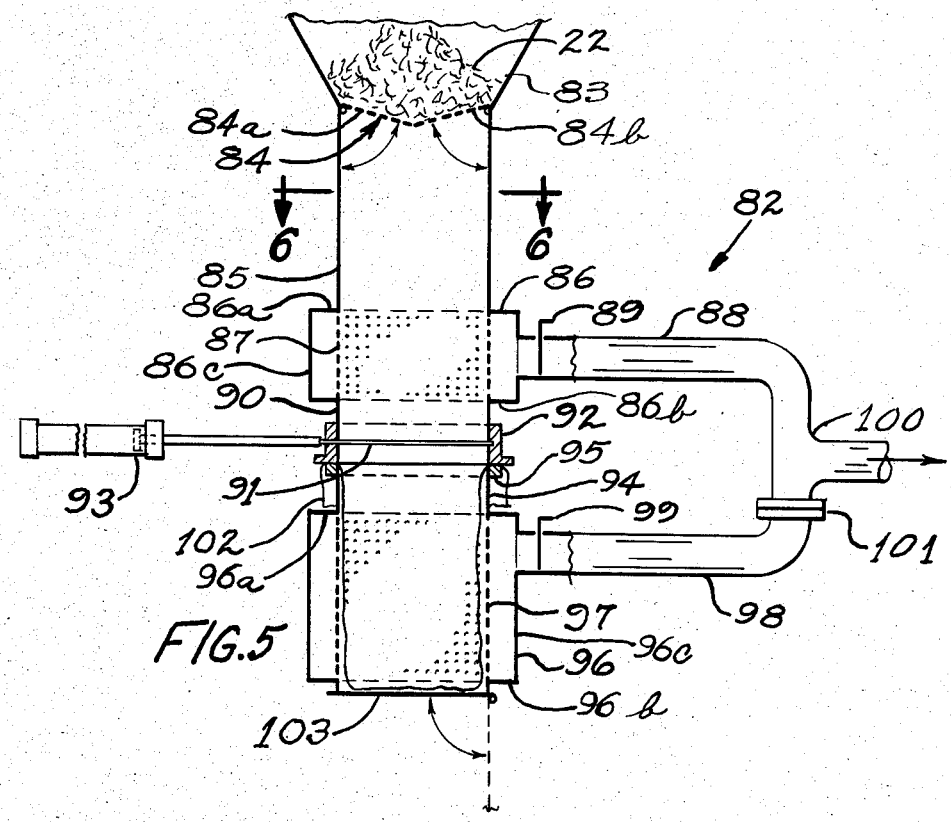
FIG. 5 is a fragmentary schematic elevational view of packaging apparatus representing a fourth embodiment of the invention.

FIGS. 5 and 6 schematically show a packaging apparatus 82 constructed in accordance with the invention and including a hopper 83 having a fibrous material control gate 84 at the bottom comprising a pair of perforated plates 84*a* and 84*b* pivotally mounted for movement to open and closed positions. The hopper 83 is connected to an inlet duct 85 leading to an upper suction housing 86 including a pair of opposite end walls 86*a* and 86*b* with openings respectively therein and an enclosing sidewall 86*c*. A perforated duct 87 aligned with the inlet duct 85 runs through the housing 86. An air exhaust duct 88 connected to the housing 86 leads to a suction fan (not shown). The duct 88 is provided with a damper or flow control valve 89.

An outlet duct 90 from the suction housing 86 is normally closed by a fibrous material control gate 91 operable between open and closed positions in a frame 92 by an actuator 93. An inlet duct 94 has a frame 95 cooperable with the frame 92 and leads to a lower suction housing 96 including a pair of opposite end walls 96*a* and 96*b* with openings respectively therein and an enclosing sidewall 96*c*. A perforated duct 97 aligned with the inlet duct 94 runs through the housing 96. An air exhaust duct 98 connected to the housing 96 leads to the same suction fan (not shown) as the duct 88. The duct 98 is provided with a damper or flow control valve 99. A connecting duct 100 joining the ducts 88 and 98 is provided with a pivot joint 101, whereby the inlet duct 94, frame 95, suction housing 96, duct 98, etc. may be pivoted to a position such as shown in FIG. 6, a porous bag 102 inserted in the inlet duct 94 and perforated duct 97 with open end looped over the frame 95, and the assembly pivoted back into alignment with the outlet duct 90 and frame 92 as shown in FIG. 5. A bottom door 103 is provided for use in removing a filled bag 102. An alternative side door 104 is shown in broken lines in FIG. 6.

Loose fibrous material 22 accumulates in the hopper 83 until the control gate 84 is opened, control gate 91 and flow control valve 99 being closed and flow control valve 89 being open. When the control gate 84 is opened, fibrous material 22 is compacted in the zone of the perforated duct 87 and piled up on the control gate 91 to a density dependent on the degree of suction in the suction housing 86. When the desired amount of fibrous material is present atop the control gate 91, control gate 84 is closed, flow control valve 89 is closed, control gate 91 is opened, flow control valve 99 is opened, the compacted fibrous material 22 moves into the bag 102, more fibrous material 22 is accumulated in the hopper 83 while air is allowed to pass through the perforated plates 84*a* and 84*b*, and the fibrous material 22 in the bag 102 is further compacted. Flow control valve 99 is then closed, control gate 91 is closed, the exhaust duct 98 is pivoted to the position of FIG. 6, the filled bag 102 is removed, a new empty bag is installed, and the exhaust duct 98 is pivoted back to align outlet duct 90 and inlet duct 94. Flow control valve 89 is then opened and the cycle is repeated.

Figure 7:
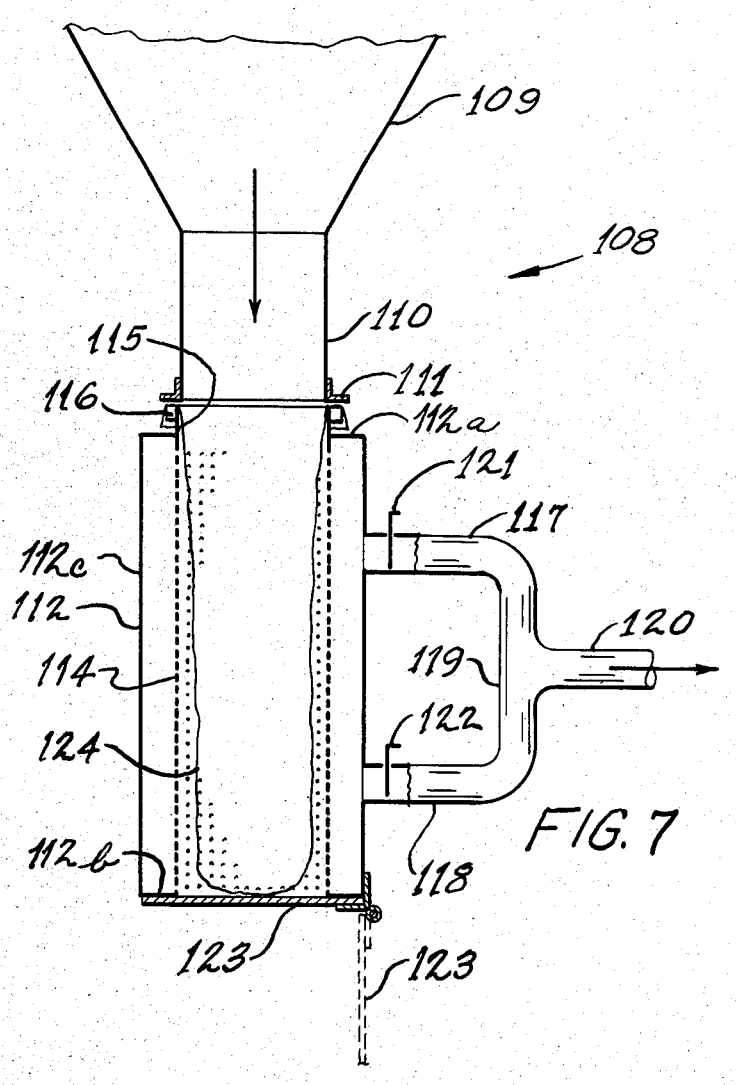
FIG. 7 is a fragmentary schematic elevational view, partially in section, of packaging apparatus representing a fifth embodiment of the invention.

FIG. 7 schematically shows a packaging apparatus 108 constructed in accordance with the invention and including a hopper 109 having a discharge duct 110 surrounded at a lower end by a frame 111. The hopper, discharge duct, and frame are movable up and down. Beneath the frame 111 is a suction housing 112 including a pair of opposite end walls 112*a* and 112*b* with openings respectively therein and an enclosing sidewall 112*c*. A perforated duct 114 runs through the housing 112 in alignment with an upper inlet duct 115 surrounded by a frame 116. An upper air exhaust duct 117 and a lower air exhaust duct 118 are connected to the suction housing 112 and joined by a connecting duct 119. A fan inlet duct 120 connects the duct 119 to a suction fan (not shown). The ducts 117 and 118 are provided respectively with flow control valves or dampers 121 and 122. A bottom door 123 is pivotally mounted adjacent the lower end of the suction housing 112.

With the bottom door 123 closed and the hopper 109 raised, a porous bag 124 is inserted in the duct 114 and the open end thereof looped over the frame 116. The hopper is then lowered until the open end of the bag is clamped between the frames 111 and 116, and the suction fan (not shown) is turned on. Fibrous material (not shown) is then drawn out of the hopper into the bag and compacted therein. During this time, both of the flow control valves 121 and 122 may be open, or if desired, only the bottom valve 122 may be open initially and only the top valve 121 during the latter part of the bag-filling operation. The hopper 109 is then raised, the open end of the bag 124 is closed, the suction fan is turned off, and the filled bag is removed through the bottom door 123.

Figure 3:
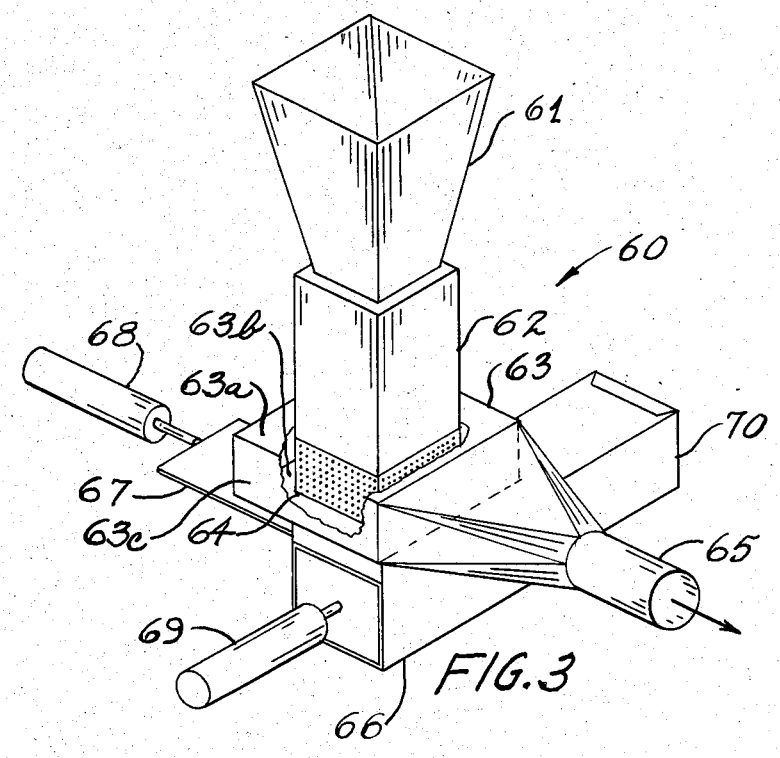
FIG. 3 is an enlarged fragmentary schematic isometric view, with, portions broken away, of the second embodiment of the invention.
Figure 4:
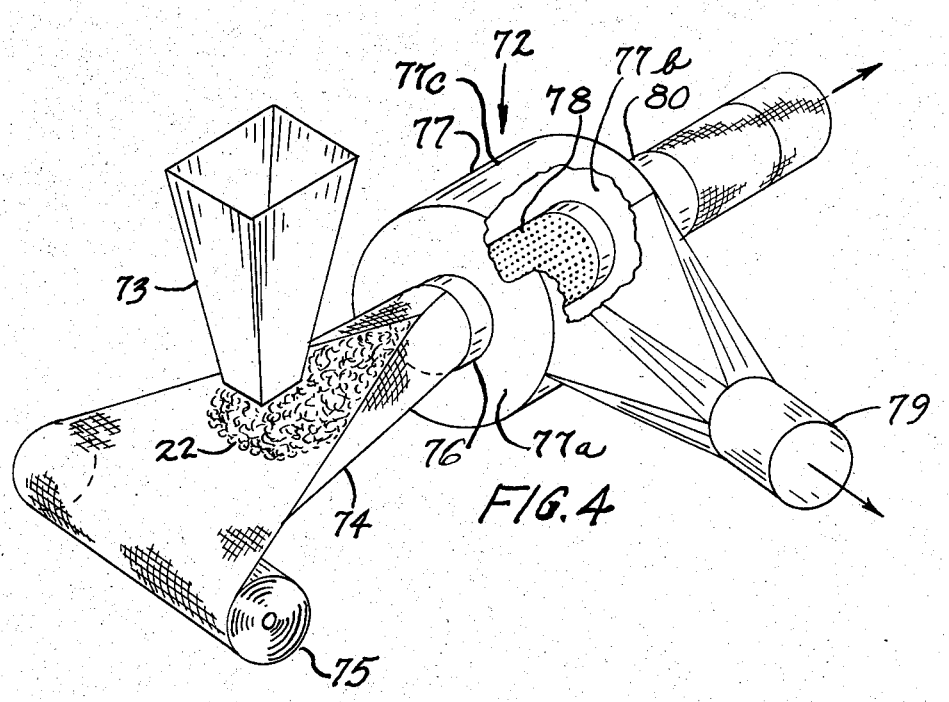
FIG. 4 is an enlarged fragmentary schematic isometric view, with portions broken away, of the third embodiment of the invention.
Figure 8:
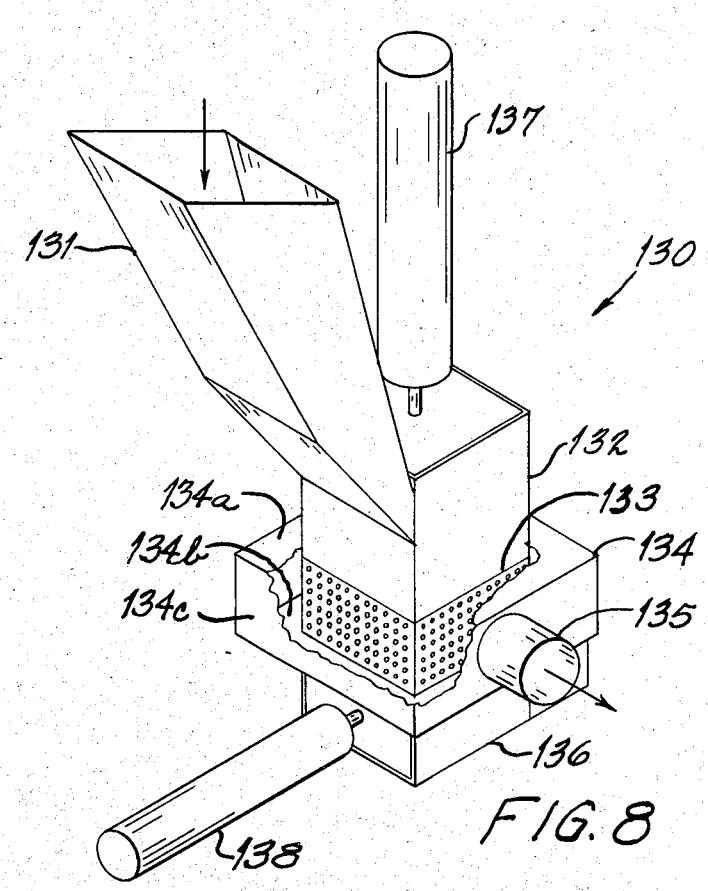
FIG. 8 is fragmentary schematic isometric view, with portions broken away, of packaging apparatus representing a sixth embodiment of the invention.

FIGS. 8–11 illustrate an embodiment of the invention similar to that of FIG. 3, but having mechanical compaction as well as vacuum compaction of fibrous material. FIG. 8 shows an apparatus 130 including a chute 131 for feeding fibrous material to a casing 132 opening to a perforated duct 133 extending through a suction housing 134 connected to an air exhaust duct 135. The suction housing 134 includes a pair of opposite end walls 134*a* and 134*b* with openings respectively therein and an enclosing sidewall 134*c*. The duct 133 is open to a bagging housing 136. An actuator 137 is associated with the casing 132 and an actuator 138 is associated with the bagging housing 136. The actuator 137 operates a compression plate 139 (FIGS. 9–11) and the actuator 138 operates a pushing plate 140 for a bagging operation wherein fibrous material 22 is pushed into a bag 141.

Figure 9:
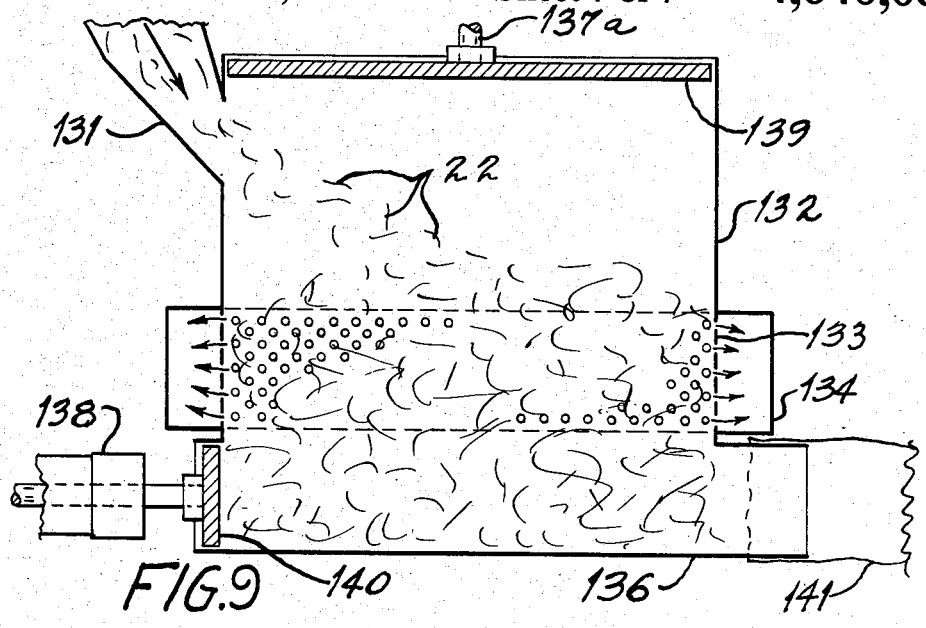
FIG. 9 is a fragmentary schematic vertical sectional view of a lower portion of the apparatus of FIG. 8.
Figure 10:
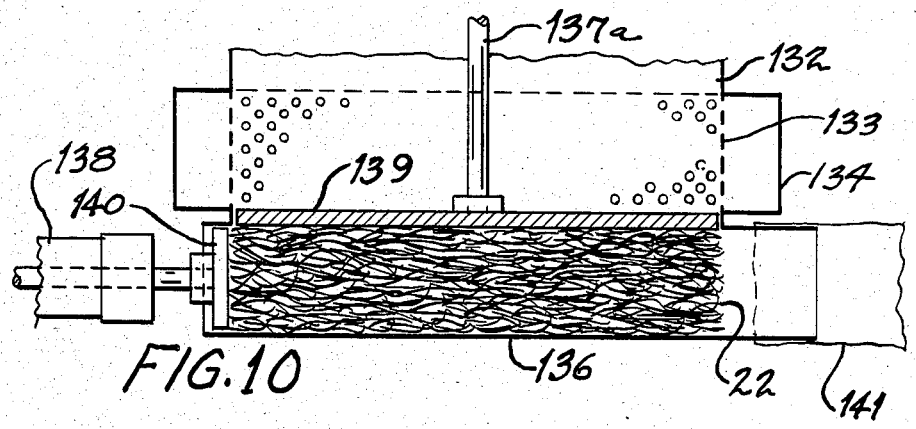
FIGS. 10 and 11 are views similar to FIG. 9, but with various parts shown in different positions.
Figure 11:
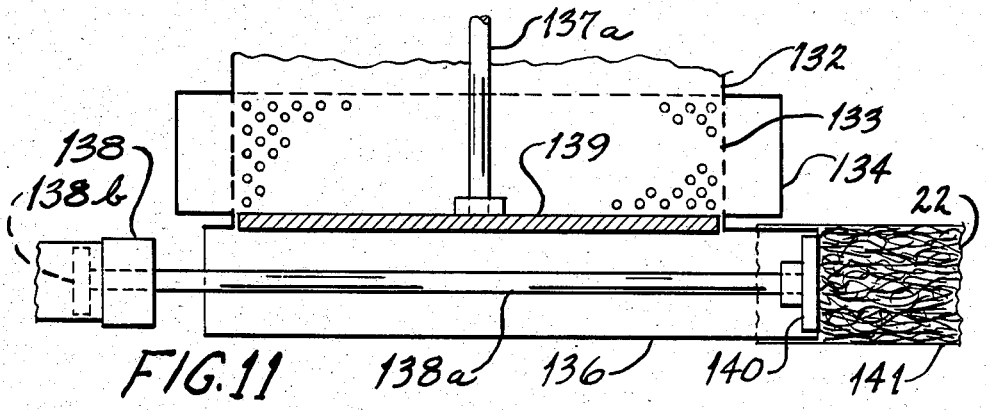

Loose fibrous material 22 is fed into the chute 131 and casing 132 while the compression plate 139 is in the raised position shown in FIG. 9. The fibrous material is vacuum-compacted by the exhaustion of air through the perforated duct 133, the suction housing 134, and duct 135. Then it is further compacted mechanically by the movement of the compression plate 139 to a lowered position shown in FIGS. 10 and 11, the movement being effected by a piston rod 137*a* of the actuator 137. Finally, the pushing plate 140, under the influence of a piston 138*b* and piston rod 138*a* of the actuator 138, moves the compated mass of fibers 22 out of the bagging housing 136 into the bag 141, as shown in FIG. 11. Infeed of fibers 22 to the casing 132 is interrupted as the compressison plate 139 is lowered and does not resume until the plate 139 again reaches the raised position.

Various fibers may be packaged by the apparatus of the invention, but the apparatus has been found particularly useful for packaging glass fibers. Further, the apparatus is suitable for packaging "cubic" blowing wool insulation such as produced by the apparatus of U.S. Pat. Nos. 4,184,643 and 4,296,164.

I claim:

1. Apparatus for vacuum-compacting and packaging loose fibrous material within a web of porous material comprising a suction housing having a pair of opposite end walls and an enclosing sidewall, said end walls having a pair of aligned openings respectively therein, a perforated duct extending through the suction housing in spaced relationship to the enclosing sidewall, having inlet and outlet openings aligned respectively with the openings in said end walls, and being formed of material having perforations therein, the perforations being of a size normally preventing passage of fibrous material while allowing passage of air therethrough, means for passing a web of porous material through the perforated duct and existing from said outlet opening, supply means for supplying loose fibrous material onto said web of porous material upstream of said inlet opening and accommodating the passage of air to the inlet opening of said perforated duct, an air exhaust duct communicating with said housing, and means for forming said web of porous material into a sleeve around said fibrous material upstream of said outlet opening so that as said filled sleeve passes through said housing it is evacuated and collects said fibrous material.

2. Apparatus as claimed in claim 1 wherein the web porous material includes a scrim having loose fibrous material deposited thereon upstream of said perforated duct and formed into a scrim sleeve as it passes through the perforated duct, the scrim sleeve being the sleeve for collecting said fibrous material.

* * * * *